United States Patent [19]

Barnett

[11] 4,150,827

[45] Apr. 24, 1979

[54] ECONOMIC BOARD GAME

[76] Inventor: David A. J. Barnett, "Little Ridings", Green End Rd., Radnage, High Wycombe, Buckinghamshire, England

[21] Appl. No.: 715,730

[22] Filed: Aug. 19, 1976

[30] Foreign Application Priority Data

Aug. 19, 1975 [GB] United Kingdom ..... 34458/75

[51] Int. Cl.[2] ..... A63F 3/00

[52] U.S. Cl. ..... 273/256

[58] Field of Search ..... 273/134, 256, 278, 257, 273/279

[56] References Cited

U.S. PATENT DOCUMENTS

| | | | |
|---|---|---|---|
| 2,174,058 | 9/1939 | McGennis | 273/134 AF |
| 2,794,642 | 6/1957 | O'Neill | 273/134 AF |
| 3,058,747 | 10/1962 | Nemetsky et al. | 273/134 AF |
| 3,799,552 | 3/1974 | Lefevre | 273/134 AF |

*Primary Examiner*—Richard C. Pinkham
*Assistant Examiner*—Scott L. Brown
*Attorney, Agent, or Firm*—Browdy and Neimark

[57] ABSTRACT

A board game played with dice in which the players are involved in a trading situation, the game including (1) a board marked with a plurality of stations defining a route to be followed and with areas representing a plurality of trading enterprises, (2) a set of cards bearing instructions for establishing a set of economic determinants and (3) indicators for effecting and/or recording, preferably on the board itself, trading transactions between a bank and the players.

16 Claims, 19 Drawing Figures

MARKET
PROFITABILITY CARD

ENTERPRISE

MARKET
PROFITABILITY CARD

DECREASE
PROFIT
BY 3 COLUMNS

ENTERPRISE

MARKET
PROFITABILITY CARD

INCREASE
PROFIT
BY 4 COLUMNS

ENTERPRISE

ECONOMIC DETERMINANT
MATRIX CARD

| SALES PRICE $ | AGENTS PRICE $ | COST PRICE $ | MARKET VOLUME |
|---|---|---|---|
| 200 | 160 | 100 | 50 |
| 210 | 168 | 105 | 54 |
| 220 | 176 | 110 | 57 |
| 230 | 184 | 115 | 61 |
| 240 | 192 | 120 | 64 |
| 250 | 200 | 125 | 68 |
| 260 | 208 | 130 | 71 |
| 270 | 216 | 135 | 75 |
| 280 | 224 | 140 | 78 |
| 290 | 232 | 145 | 82 |
| 300 | 240 | 150 | 85 |
| 310 | 248 | 155 | 89 |
| 320 | 256 | 160 | 92 |
| 330 | 264 | 165 | 96 |
| 340 | 272 | 170 | 100 |

PRIVATE ENTERPRISE

ECONOMIC BOARD GAME

This invention relates to a board game which involves the players in a trading situation.

According to the present invention, there is provided apparatus for a board game, played with a die or dice, in which the players are involved in a trading situation, which apparatus comprises (1) a board marked with (a) a plurality of stations defining a route to be followed by one or more mascots during the course of the game, and with (b) areas representing a plurality of trading enterprises which may be industrial, commercial and/or service enterprises; (2) means for establishing a set of economic determinants which affect the terms on which players may participate in trading during the game and which economic determinants can be changed at least at the start of each round of the game; and (3) means for effecting and/or recording trading transactions between a bank and the players.

The stations defining a route to be followed by one or more mascots during the course of the game can consist of a series of squares located either at the center of the board or around the periphery of the board. Each of the enterprise areas can include information concerning the terms on which the players may participate in trading during the game; the economic determinants can operate to select some of the information contained within each of the enterprise areas so that the selected information governs the terms of trading in each enterprise during a given part or round of the game. The economic determinants can comprise a number of cards which may be placed on the board or beside the board, and which contain instructions concerning the trading terms in use during the game. The means for effecting and/or recording trading transactions can conveniently be a collection of monetary tokens which are held in a bank and which are administered by one of the players (who is termed the banker). Alternatively, the banker may keep a record of credits which are available to the players.

There are numerous versions of the game which differ in complexity. In the third embodiment of the game, the enterprise areas on the board comprise two areas, the first area representing a series of trading units or factories together with associated constant parameters (for example a fixed premium to be paid to the bank by a player who wishes to operate in that trading unit during the game, and a fixed rental to be paid to the bank in respect of that trading unit at the start of each round of the game); and the second area including at least one variable parameter the values of which are related to the possible throws of the die or dice on the one hand, and with the operation of one or more economic determinants on the other hand. In a simple version of the game, there can be a single such parameter (trading profit on orders) which functions independently of any other parameters. In more complicated versions of the game, there may be a different parameter, for example market volume, which operates in conjunction with other variable parameters, for example manufacturing costs and sales price. Other variable parameters may be introduced in the most complicated versions of the game, these being, for example, agent's price and royalty costs.

All of the versions of the game are played in accordance with the following basic rules:

(1) Each of the players is able to use a predetermined amount of trading capital during the game;

(2) the players each select one or more enterprises, or one or more trading units within one or more enterprises, for their operation during the game (the selection of one enterprise or of one trading unit within an enterprise by a given player serving to exclude the selection of that same enterprise or trading unit within an enterprise by any other player unless or until one or other of the players is given an option of modifying the enterprises or the trading units in which he is operating);

(3) the means for establishing a set of economic determinants are then operated;

(4) the players throw a die or dice in turn, the value of the throw obtained by a player being used to determine the trading options available to him, there being a predetermined option or range of options available for any given throw, at least some of which options are an opportunity to gain a trading profit and/or to buy trading orders from a bank at terms dependent upon the current economic determinants, such trading orders being subsequently sold to the bank at terms dependent upon the economic determinants current at the time of sale; the player being free to select the enterprise in which a trading profit or a trading order option is to be exercised;

(5) at least one of the players moves a marker around the board in response to the throws of the die or dice that he, or each of the players, makes;

(6) at the end of the trading described above, and/or when the marker, or the said predetermined one of the markers, lands on one or more predetermined stations, the means for establishing the set of economic determinants are operated again so as to produce a new set of circumstances to govern the subsequent round or part of a round of the game; and (7) play continues in the way described until terminated, whereupon the player whose total assets are greatest is the winner.

There are numerous embodiments of the game which differ in complexity. The "variables" which affect the complexity of different embodiments of the game are discussed in the paragraphs below.

(a) General mode of play.

(1) Each player may move a marker around the stations of the board in response to the die or dice throws which he makes. Thus when each player throws the die, the resultant throw determines the option or options open to him and also determines the number of moves to be followed by his marker.

(2) One player only (generally the banker) moves a marker around the board. The throw obtained by a given player thus results in movement of the banker's marker and determines the trading option available to the player.

(b) The number of enterprises and the number of factories in each enterprise. These can be almost infinite variability in these factors. Nevertheless, it is most convenient for there to be about six enterprises each having about four factories. The factories may have infinite capacity, so that there is no limit to the number of orders which a player may obtain provided that he has rented an appropriate factory. Alternatively, the factories can have a given capacity, which may differ between the various factories in a given enterprise. With such an arrangement, more skill is required on the part of the player to ensure that he can fulfill any orders which during the course of the game he may purchase.

(c) The options. When a given throw of the die or dice it obtained, one or more options may be available to the player. For some or all of the throws, the player will have the option of taking a trading profit or purchasing orders in a given enterprise from the bank. Other options which may be included are taking a chance card; taking a market development option, for example by selecting a market development card which will give details of specific entitlement with regard to further trading; he may have the option of buying and/or selling a factory; or he may have an extra throw of the die or dice (for example when his first throw is a six or a double six).

(d) The economic determinants. There will be a profit or a purchasing price and a sales price for each enterprise. These values will generally vary between the enterprises represented. In more complicated versions of the game, the concepts of royalties and agency may be introduced. The purchase price for an order may be replaced by a capital cost and a labor cost.

The stations followed by the marker(s) during the course of the game may bear instructions to the players. Some or all of the instructions on the stations of the board may relate generally to all of the enterprises; alternatively some of the instructions displayed at various stations on the board may be specific to a given enterprise or factory within an enterprise, so that different players may be affected (this is particularly valuable in those versions of the game where only a single marker is moved around the board).

In one version of the game, the means for establishing a set of economic determinants can simply be a set of reference tables representing cost and sale prices, there being different tables for each of the enterprises involved. In this version of the game, a player who throws a 5 on the die would, if he chose to accept the order option, multiply a unit cost by the throw of the die (i.e. 5) and pay this product to the bank. In a more complicated version, the reference tables for cost prices may be replaced by two sets of tables, one relating to materials cost, and the other relating to labor cost. Different enterprises would have different reference tables either for straight cost price or for labor cost plus materials cost. A further way of differentiating between different enterprises is to incorporate a further economic determinant. This may take the form of a market volume matrix which is invariant over the range of enterprises or a plurality of market volume matrices, one for each enterpise. This may be a table with a series of columns, each column containing multiplicands to correspond with the various possible throws or the die or dice. Instead of multiplying a cost price (or a labor cost and a material cost) by the throw on the die or dice, the multiplicand set out in the market volume matrix for the throw obtained is employed to give the product.

The tables and matrix or matrices, where used, may contain a series of values (e.g. as columns) only one of which is operational in any round of the game. With this arrangement, one of the players may turn over one or more cards at the start of the game and at the beginning of successive rounds of the game in order to determine which set of values is to be used for each of the economic determinants. Alternatively, there may be a greater number of tables and matrices, each with only a single range of values, and one of each type of table and matrix is selected from the pack thereof.

Advantageously, the apparatus further includes means for recording orders purchased by each of the players which orders are yet to be sold; this may be incorporated with the market volume matrices, to give a peg board with holes for the pegs set between each of the matrix columns. Each player would then be given a number of pegs of a given color, so that he may mark on the peg board the orders which he has purchased.

The means for representing a plurality of industrial, commercial and/or service enterprises will generally consist either of a series of markings upon the board, or of a separate board devoted solely to the enterprises. Factors affecting the trading of the various enterprises may be set out upon the respective areas. These factors may consist, for example, of a maximum production capacity; a premium payable when a given factory within an enterprise is adopted by a player; a rental value, which is paid by the player operating the respective unit at the beginning of each round of the game; and a mortgage value which may be used should the player require to mortgage a factory in order to increase his liquidity. Any industrial, commercial or service industry may constitute an enterprise in the game. For example, the enterprises may be selected from engineering; electrical components; breweries; domestic appliances; furniture; chemicals; textiles; motor components; advertising; marketing; research; and legal services. These will generally be a plurality of "factories" in each of the various enterprises. Since in practice these various services and industries have different materials/labor cost ratios, the game may be made more interesting if appropriately chosen materials and labor costs are employed for the respective industrial, commercial or service enterprises.

According to preferred embodiments of the present invention there is provided apparatus for a board game of the type in which the players are involved in a trading situation and in which one of the players moves a marker about the board, and all of the players taking turns to throw a die and competing with one another to maximize their trading profits during the game by purchasing orders for goods or services and subsequently selling these to a banker at predetermined stages during the course of the game, which apparatus comprises (a) a board marked firstly with a plurality of squares defining a route to be followed by a marker moved by one of the players in response to the throws of the die which he makes, some or all of the squares bearing instructions affecting the terms of trading during the game; and secondly with a plurality of enterprise areas which may be industrial, commercial and/or service enterprises, each enterprise including a plurality of trading units or factories each of which has a specified maximum production capacity, a premium value and a fixed rent associated therewith; (b) monetary tokens which, in toto, constitute a "bank"; and (c) a plurality of economic determinant cards which, when the game is being played, determine the conditions under which trading can occur. These embodiments of the game are played according to the following rules:

(1) at the start of the game, a player is chosen to act as banker and the banker then distributes a predetermined value of monetary tokens to each of the players, ensures that each player has a set of distinctive markers, and draws one of each of the economic determinant cards from their respective packs;

(2) each player chooses to rent one or more (up to a predetermined maximum number) factories in one or more enterprises and pays the premium and the rent associated therewith to the bank;

(3) each player casts a die in turn; the banker moves his marker around squares on the board according to the throw obtained; and all of the players having options open to them which options are determined by the throw obtained and which in every case include an option to take a profit or to buy from the bank an order in an enterprise which the player may specify, the size of the order being governed by the throw of the die obtained in conjunction with the economic determinants current at that time;

(4) play continues until the banker's marker completes a full circuit of the board, whereupon, if orders have been bought, the banker purchases these orders for the bank for which the players have appropriate factories of sufficient capacity to complete any other orders being forfeit;

(5) thereafter the banker draws a further one of each of the economic determinant cards which are to govern the play during the second round; and (6) play continues in like manner (but with a different player having first throw of the die in successive rounds of the game) until the game is terminated, whereupon the player with the greatest value of monetary tokens is the winner.

In the preferred embodiments defined generally above, some of the squares on the board may bear instructions which affect the economic determinants, so that the trading terms of the players may alter between the moment when they purchase an order from the bank and the end of the round when the orders are sold to the bank.

Some optional details concerning the mode of play will now be described.

The game is in general suitable for from two to six players, one of whom acts as banker. The banker may play in the same way as the other players, or he may choose to act solely as banker without participating in the game proper. Where only one player moves a marker around the board, this player will usually act as banker.

The board may be marked around its periphery or at its center with a plurality of squares which represent the stations occupied by the marker(s) during the course of the game. One square may represent the starting position, and the passage of a marker (usually the banker's marker) beyond the starting position may be taken to represent the end of one financial year (i.e. one round of the game), and a number of operations may then take place which will be described hereafter. The board, or a second board, may be marked out with a plurality of areas each associated with a particular enterprise; at the start of the game, each player chooses one or more factories (of one or several enterprises, as he may choose); in some embodiments, the player has the option, at various stages during the course of the game (e.g. at the end of a round), to modify the number of factories at his disposal. With such an arrangement, the number of factories obtainable in any one round may be limited.

Some or all of the positions in the circuit followed by the players around the board may include instructions which the player must obey when his marker lands upon the appropriate square. For example, some of the squares may be marked "royalty" together with the name of one of the enterprises, any player landing on such a square being required to pay a specified royalty to another player, if any, who holds a royalty card relating to the specified enterprise. For example, if a player lands on a square marked "royalty-textiles", then that player must pay a royalty to the player holding a textiles royalty card. The royalty may be a fixed sum of money, or may be dependent upon the number of factories or enterprises or orders in the possession of the player who holds the relevant royalty card. In addition, a number of squares may be marked "Chance", so that when a player lands on such a square he chooses a card from a stack of "Chance" cards which are placed face downwards on the board. He then looks at the card, and obeys whatever instruction is written upon it. Yet other squares may be marked "market development option". If a player lands on such a square, he may pay the banker a specified fee and then collect a market development card from a stack of such cards placed face downward on the board, the writing on the card indicating what option is available to the player. The royalty cards are advantageously included in the market development cards. Certain of the squares on the board may be marked with further instructions to a player landing thereon — for example, "goodwill increases — collect £ 250"; or "strike in all your factories; forfeit ⅓ of all orders".

A market record system may be employed consisting of a peg board marked with the appropriate enterprises, for example along the top edge, and with a series of numbers representing the orders in each of those enterprises, for example along one side. Each player may then have a different colored peg which is inserted into the board to record the outstanding number of orders he has in any given enterprise. Advantageously, the record system is a part of the market volume matrix; then when one player obtains a given order in a given enterprise (as determined by the dice or die throw), that order cannot be obtained by any other player during that round of the game, since the peg hole adjacent the order will be filled by the player's peg. Hence there will be no order option open in the particular. enterprise concerned to another player who throws the same number on the die or dice as the first player.

At the start of each round of the game, each player decides what production capacity (in any of the enterprises) he wishes to use in the coming round (i.e. financial year) of the game. In one embodiment, a player may change the number of factories and/or enterprises (and hence his production capacity) during the course of a given circuit of the board only if he lands on a market development square and collects a market development card giving him the option so to do.

The setting up and playing of three embodiments of the game will now be described in greater detail with reference to the accompanying drawings, in which:

FIGS. 1 and 1A each show one half of a game board and together illustrate the entire game board for use in the embodiment known as "commercial enterprise";

First embodiment-Commercial Enterprise

The first and simplest of the three embodiments of the game is described by the applicant under the title "Commercial Enterprise". In this game, each player can earn a profit direct from the banker for any order he secures, in any enterprise in which he decided to operate at the start of the game. As can be seen from FIG. 1 of the drawings, the enterprises involved in this game are breweries, general engineering, chemicals, textiles, furniture and domestic appliances. The profit which a player earns depends upon the number thrown on the die and the profitability of the enterprise or enterprises in which he engages. The profitability of each enterprise is decided, initially and thereafter at each round of the game, by Market Profitability cards which give instructions to the banker to increase or decrease the profits in each of the six enterprises. The profit earned is paid in cash by the banker to the player as soon as it is earned. This money, together with any money held, enables the player to buy or change factories, to pay fixed costs, to purchase market development rights and to pay penalties on Chance and Market Development Option cards. When a player throws the die, he can, as well as earning a profit on an order, exercise an option. The options are (a) to take a Chance card (if the throw on the dice is 1 or 2), which is a free transaction; (b) to buy a Market Development Option card (if the throw on the die is 3 or 4); (c) to buy and/or sell a factory (if the throw on the die is 5 or 6); and (d) to have an extra throw for a bonus profit (only if the throw on the die is 6). A player who throws a six may choose whether to have a bonus profit throw or to buy and/or sell a factory, but not both. The Market Development Option cards include cards giving the player a royalty (specific to whichever enterprise is named on the card); earning a bonus profit (some cards specify to which enterprise the bonus relates, and are effective at each throw of the die which the holder of the card makes throughout the game; others may be used once only in whatever enterprise the card holder chooses); or incurring a penalty. The orders are secured for one year, which is represented by the time it takes the banker to move his marker from the start position around the banker's year section of the board. At the year end, the board is cleared, and the orders again become available to all the players.

Figure 7:
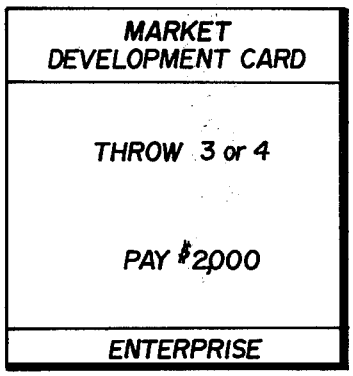
FIGS. 7 and 8 show the obverse and reverse, respectively, of a typical "market development" card as used in all embodiments of the game.
Figure 8:
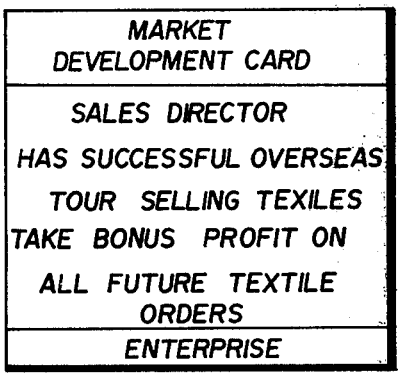
Figure 9:
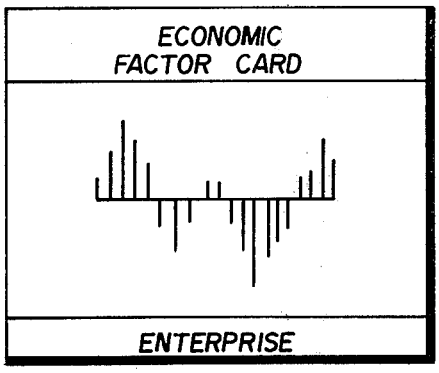
FIG. 9 shows the obverse of a typical "economic factor" card as used in all embodiments of the game.
Figure 10:
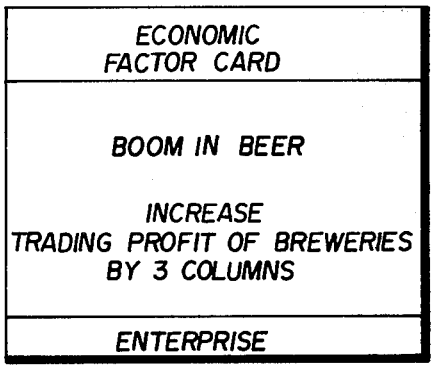
FIGS. 10 to 14 show the reverse sides of typical "economic factor" cards for use in various embodiments of the game.
Figure 11:
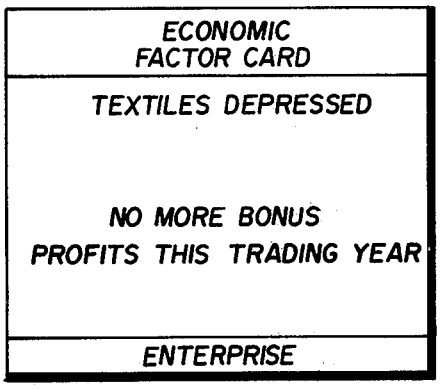
Figure 12:
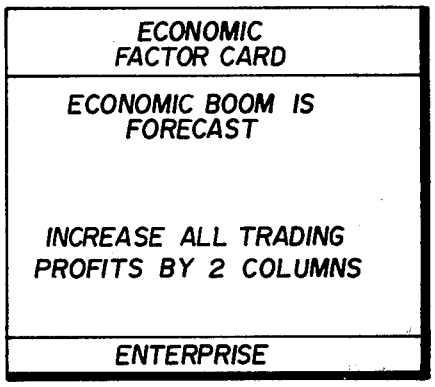

The board and cards for use in "Commercial Enterprise" will now be described with reference to the drawings and in greater detail. The board 1 (see FIG. 1) is divided into (a) a track 2 defining the banker's year and (b) six enterprises or marketing areas 3*a* to 3*f*. The banker's year section is located at the center of the board, and comprises fourteen squares 20 four of which are marked "economic factor". Only the banker moves a mascot during the game, his mascot being moved around the squares which constitute the banker's year. If his mascot lands on an economic factor square, he draws an Economic Factor card (typical examples of which are illustrated in FIGS. 9 to 12) and complies with its instructions. The six enterprise areas each include a primary area 4 and a secondary area 5. The primary area 4 bears indicia marking a trading profit on orders section 6. The latter is tabulated as shown and includes a column 9 having numerical indicia correspondingly to those of the dice. The secondary area 5 is sub-divided into a royalty section 7 and a factory capacities and fixed costs section 8. A player may obtain the right to receive royalties if he has purchased a Market Development Option card (see FIGS. 7 and 8) which confers a royalty right. For his royalty rights to be valid, the player must place one of his set of mascots on the royalty section 7 of the appropriate enterprise area 3*a* to 3*f*. The player may then collect the stated royalty from any other player who obtains any order, whether through normal trading or through a bonus order, in that enterprise. It is the royalty holder's responsibility to police and supervise the collection of royalties due to him.

Each factory section has four factories. Each factory has its stated capacity, premium and rent. The capacity of each factory (which is represented as 1, 2, 2 or 3) denotes the number of normal trading profits on orders that a player may obtain during any one round of the game (which represents a year). The players may obtain bonus profits, but again only as many as are allowed by the stated capacity of the factory. A player must exercise skill in deciding where to take his profits during the course of the game. The premium is the amount of money which a player must pay the banker in order to commence operation in a given factory. The premium is payable in advance, that is as soon as a player decides to operate in the factory in question. At the end of the game, the total amount of premiums paid by a player is added to the cash which he holds in order to ascertain his total assets. The rent is payable at the time a player first occupies a factory and thereafter is payable at the commencement of each round of the game. The board also includes an information zone 12 setting out the option open to the players as a function of the dice throws obtained.

Figures 15, 16, 17, 18:
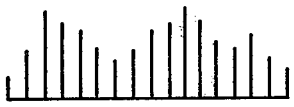
FIG. 15 shows the obverse of a typical "market profitability" card for use in the embodiment "commercial enterprise"
FIGS. 16 and 17 show typical reverse sides of the card shown in FIG. 15.
FIG. 18 shows a typical "economic determinant matrix" card for use in the embodiment "private enterprise".

The trading profit section consists of a matrix of numbers; one column 9 of numbers represents the throw of the die, another column 10 represents bonus profit, and the remaining columns 11 (only some of which are given reference numeral 11 for clarity) represent normal trading profit. The values in the fifteen columns of normal trading profit increase progressively from left to right. At any time, only one column of the fifteen normal trading columns is in operation; at the start of a game, the banker's mascot is placed in the fourth column from the left of the normal trading section in each of the six enterprises. The banker then draws a Market Profitability card (such as shown in FIGS. 15 to 17) from each of six packs which represent the six enterprises. These cards bear instructions for the movement of the banker's mascot up or down on the trading profits section; the position occupied by the mascot after this has been done indicates which column of normal trading profits is the operational column during the first round of the game. Each of the six packs of Market Profitability cards contains eighteen cards which move the banker's mascot up or down by one column (nine each); twelve cards which move it up or down two columns (six each); twelve cards which move it up or down three columns (six each); six cards which move it up four columns; and three cards which move it up five columns. Players may obtain bonus profits by throwing a six or by using a bonus profit card from the Market Development Option stack, if they have such a card. In order to calculate the profit on any order, the player consults the trading profit section by noting the value in the currently operational column of the normal trading columns which corresponds with the throw on the die which he has obtained; for example, a player operating in the general engineering enterprise who throws a three on the die will, when the banker's mascot is on the sixth column from the left of the normal trading section of the trading profit area, earn a profit of £ 5,100.

Royalties can be collected by the holder of a royalty card whenever another player earns a profit in the appropriate enterprise (whether a normal trading profit or a bonus profit). The profit can be obtained from any enterprise where a factory is occupied by the player concerned and which factory has free capacity. The capacity (1, 2, 2 or 3) represents the number of normal trading profits and the number of bonus profits which may be obtained during one round of the game — thus a factory of capacity 3 can earn its operator three normal trading profits and three bonus profits.

Setting up the game

1. Appoint one of the players as banker. Alternatively one person who does not wish to take part in the actual play may take the sole duties of the banker.

Figure 4:
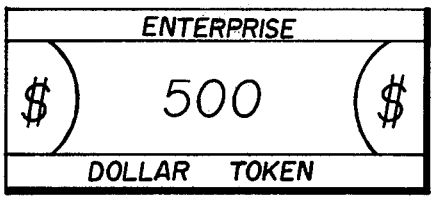
FIG. 4 shows an example of the token currency (simulated money) used in all the embodiments of the game.
Figure 5:
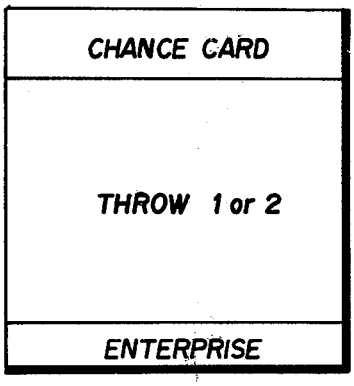
FIGS. 5 and 6 show the obverse and reverse, respectively, of a typical "chance" card used in all the embodiments of the game.
Figure 6:
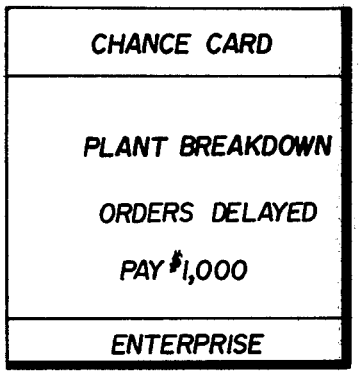

2. The banker
(a) issues each player with or $50,000 in monetary tokens (a typical one of which is shown in FIG. 4);
(b) shuffles the Chance, Market Development Option, Economic Factor and Market Profitability cards (see FIGS. 5 to 12, 15, 16 and 17) and places them in a suitable position, which may be on the board;
(c) places one banker's mascot on the start position 21 of the Banker's Year section, and
(d) positions a banker's mascot in the normal trading profit section of the Trading Profit on Orders section of each enterprise at the head of the fourth column from the left.

3. Each player
(a) selects a company name and a set of mascots;
(b) decides in which factories to operate, up to a maximum of four; and
(c) pays the banker the appropriate premium and rent for the factories occupied.

4. The banker establishes the opening profit position for each market area by drawing 6 Market Profitability cards and following the instructions on each card for each enterprise, commencing with Breweries 3*a* and moving in a clockwise direction, finishing with General Engineering 3*f*.

The Play

1. The player on the immediate left of the banker commences play by throwing the die (which is a conventional die and therefore not illustrated). The number thrown allows the player to take a trading profit in any market area for which he occupies a factory, and to take an option. To take his trading profit, the player places one of his mascots on the appropriate square of the Trading Profits section, i.e. the square which aligns with the number thrown on the die and with the banker's mascot (at the head of the operative column), and then collects the appropriate profit from the banker. For example, assume that a player occupies a Textile factory and a Furniture factory, and that the banker's mascots are positioned at the head of the columns commencing £ 4600 and £ 6300 respectively. The player throws a 3: he may therefore collect either £ 5000 or £ 5500 from the banker, depending upon whether he chooses to take a profit in the Textile or Furniture enterprise. He places his mascot over the appropriate section to denote that that order has been taken. The procedure followed when a bonus profit is available is the same as that just described for normal profit. The nature of the option available to the player depends on the number thrown, as explained previously and with reference to the information zone 12. If a player chooses to sell a factory, only the premium is recoverable from the banker, the rent already paid being forfeited. Factory sale proceeds may be offset against monies owed to the banker, and the balance paid to or collected from the banker. An option cannot be exercised before the trading profit, if any, has been taken. 2. Each player then takes it in turns to throw the die and play as described in (1) above. 3. After all the players except the banker have thrown the die, the banker takes his throw and then moves his mascot by the appropriate number of sections on the Banker's Year part of the board. If his mascot lands on a square marked "Economic Factor", the banker draws a card from the stack of Economic Factor cards (see FIGS. 9 to 12) and obeys whatever instructions are on the card. These cards include instructions such as:

"An economic boom is forecast: move all Trading Profit markers up by two columns" and:

"Textiles depressed: no more bonus profits this round in Textiles" and:

"Boom in Breweries: move Breweries Trading Profit marker up three columns".

4. Play continues with each player throwing the die in turn until the banker's mascot reaches or passes the Year End section 21 on the Banker's Year.

5. When the year end is reached, each player removes his mascots from the Trading Profit section 6 - (note if any player has more mascots on the Trading Profit section 10 or on the Bonus Profit section than he has factory capacity then he must forfeit the largest profit by repaying it immediately to the banker — for example, a player may occupy a Chemicals factory with a capacity of 2. He is therefore allowed no more than 2 mascots on the normal Trading Profit section 6 and no more than 2 mascots on the Bonus Profit section 10. If he makes a mistake and has a third mascot on either the normal or Bonus columns, he forfeits whichever of the three profits is the greatest. Each player also pays the banker the appropriate rent in advance for each factory he occupies. The banker, after he has collected all the rents due, adjusts the profit position for each enterprise by drawing a further 6 Market Profitability cards and following the instructions on each card.

6. A further year's trading then commences, starting with the player who threw the die second in the first year. The player who threw first then becomes the last player to throw except for the banker, who always throws the die last. Therefore in subsequent years each player should get the opportunity to throw first.

7. Play continues until an agreed number of years have been played or an agreed time elapsed.

8. At the end of the game each player converts his factories to cash at the premium price; and totals his cash to find the winner (being the player with most money).

Second embodiment — Free Enterprise

Figure 1:
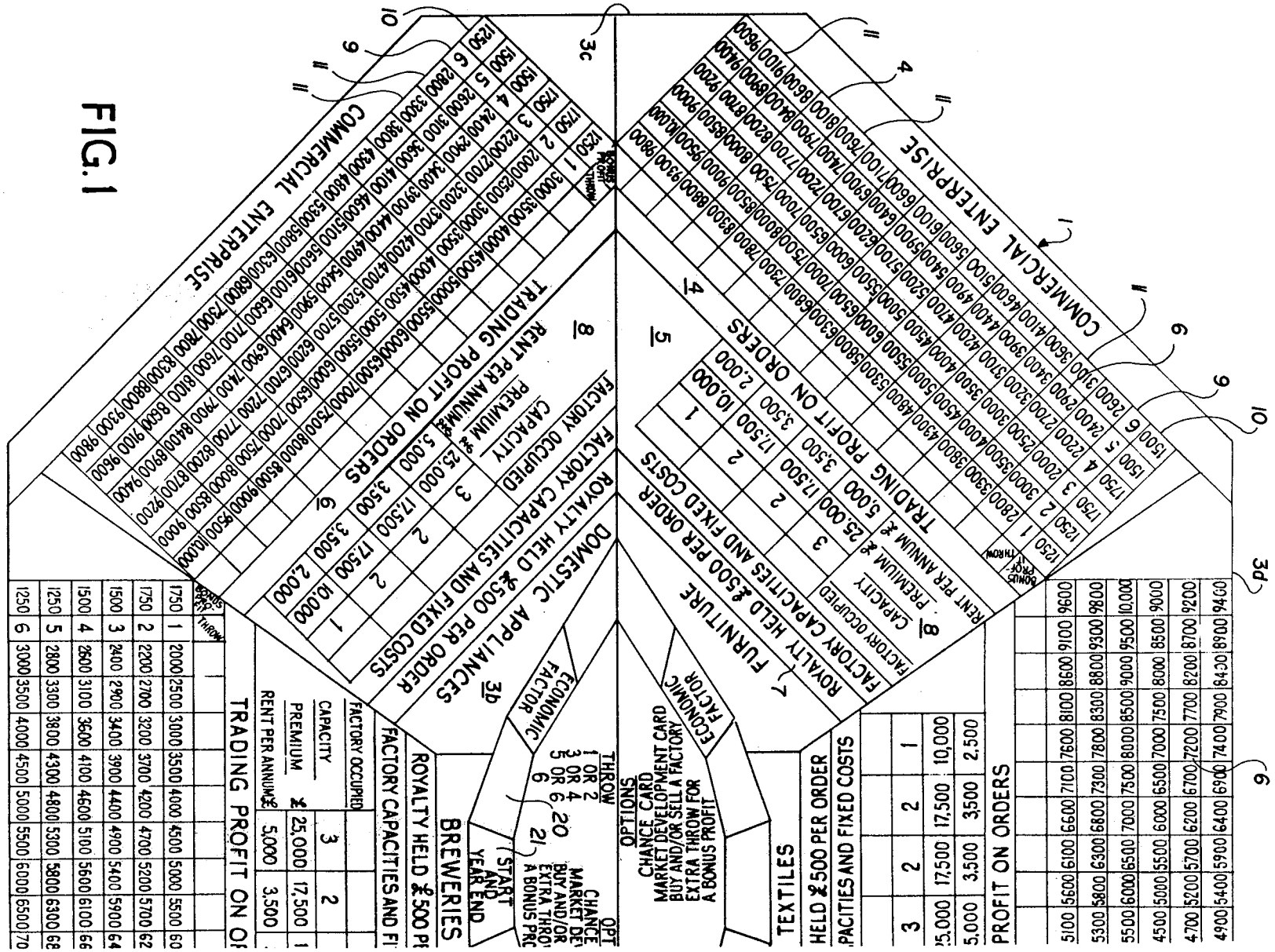
Figure 1A:
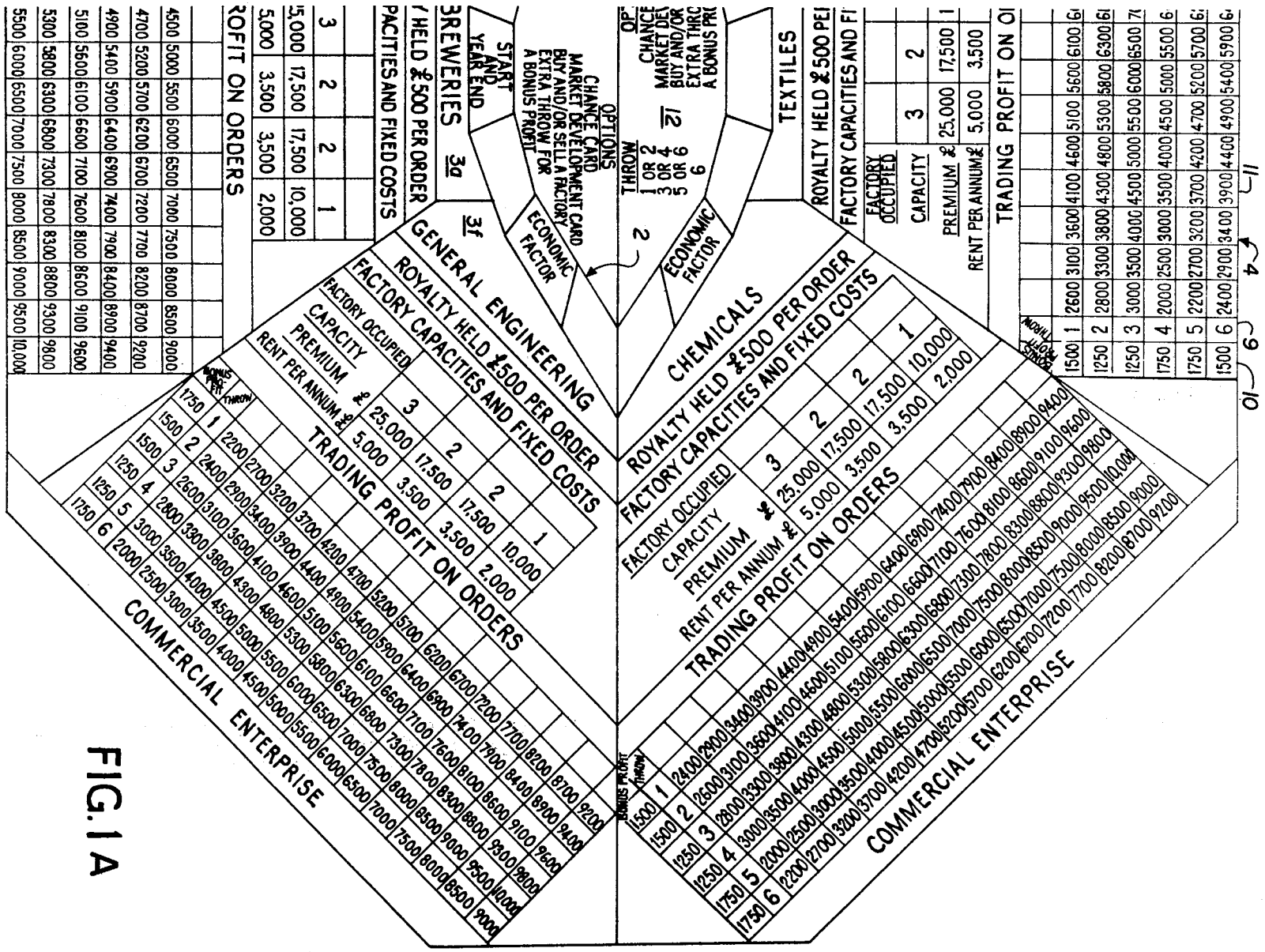
Figure 2:
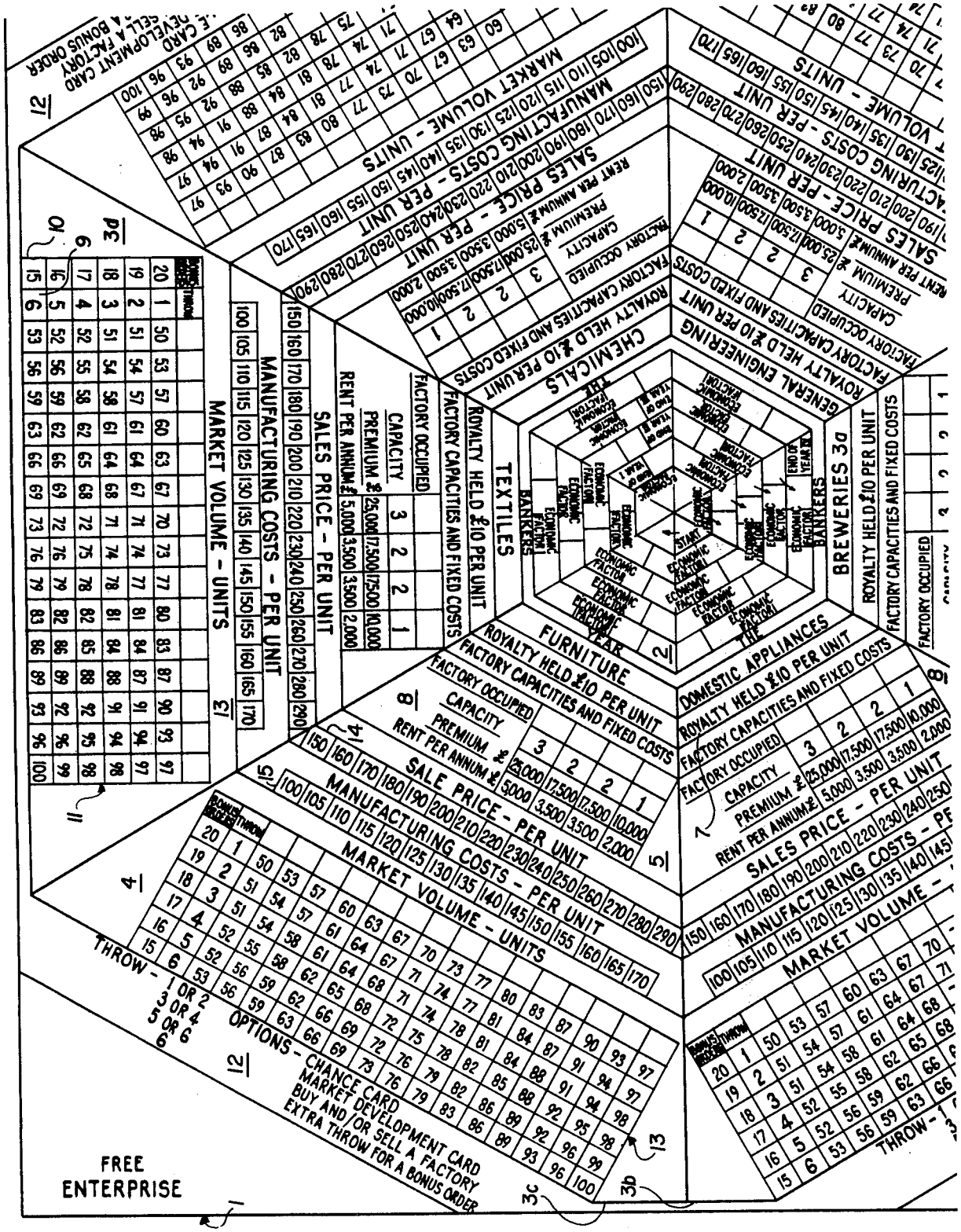
FIG. 2 shows a blow-up of a portion of the game board for use in the embodiment known as "free enterprise"
Figure 13:
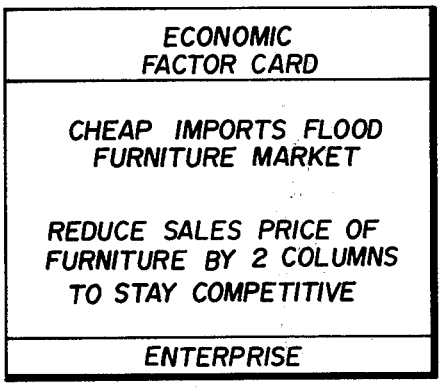
Figure 14:
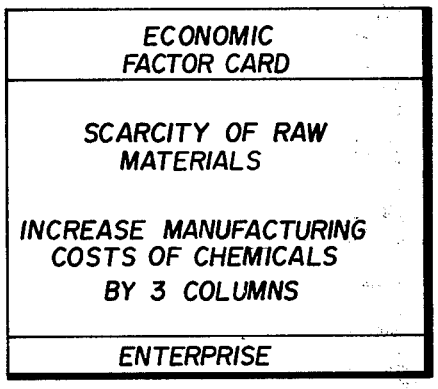

This embodiment of the game is similar in principle to Commercial Enterprise described above, but the method of earning trading profits is more complicated and the Banker's Year section of the board includes different squares for different years, there being an increasing number of squares in successive years (thus allowing for an expanding market). In FIG. 2, reference numerals identical to those of FIG. 1 are used (where that is appropriate) to denote the same areas. Whereas in Commercial Enterprise the trading profit for each enterprise was a single value determined by reference to the board, in this embodiment the trading profit is subdivided into three elements, i.e. a market volume, sales price and cost price. Each of these three elements is adjusted initially, and can be varied thereafter at the end of each round of the game, by the banker drawing Market Volume, Sales Price and Manufacturing Costs cards for each of the enterprises. These are exactly analogous to the Market Profitability cards illustrated in FIGS. 15–17. As in Commercial Enterprise, there are also Economic Factor cards which give instructions to the banker whenever his mascot lands on an Economic Factor square. The instructions on the Economic Factor cards in this embodiment of the game can relate to one of the economic determinants (market volume, sales price and manufacturing costs) in a specified enterprise; also, some of the cards contain instructions to the banker the effect of which is to vary the normal progression of his mascot on the Banker's Year section. An example of this latter type would instruct the banker to move his mascot back one year at the end of the round, instead of progressing to the next year. Examples of instructions on Economic Factor cards suitable for this embodiment are shown in FIGS. 13 and 14. The player has to pay cash to the banker for each order secured — the amount paid is the product of the current market volume and the current cost price. The player has to wait until the year's end (i.e. the end of the round) before he receives payment for the order, when he will receive an amount calculated by the then current market volume multiplied by the then current sales price. The options open to a player when he throws the die are the same as those described above in relation to Commercial Enterprise. The game known by the applicant as Free Enterprise thus introduces a more complicated profit situation, and an expanding or contracting market; the game also makes greater demands on the players' cash resources.

The board used in Free Enterprise will now be described in greater detail with reference to FIG. 2 of the drawings. As in the case of Commercial Enterprise, the board comprises two main sections, the first being the Banker's Year 2 and the secong being six enterprise areas 3*a* to 3*f*. The Banker's Year section of the board is arranged as a series of concentric elements each divided into a number of squares 20. The start of the first round of the game is in the centermost area, and the banker's mascot follows a generally clockwise spiral as shown by the arrows in the drawing. The end of the first year is marked on the board after 14 squares, four of which are marked "Economic Factor". In subsequent rounds of the game, the Banker's Year contains 18, 23 and 29 squares. The "Economic Factor" squares operate in the way described above. The six enterprise areas (which have the same titles as those in Commercial Enterprise) each include a primary area 4 and a secondary area 5. The primary area 4 bears indicia marking a market volume section 13 which is tabulated as shown and includes a column 9 having numerical indicia corresponding to those of the dice. The secondary area 5 is sub-divided into (a) a royalty section 7; (b) a factory capacities and fixed costs section 8; (c) a sales price per unit section 14; and (d) a manufacturing costs per unit section 15. The royalty and factory capacities and fixed costs sections are identical to those described above in relation to Commercial Enterprise. The Market Volume section 13 is similar to the Trading Profit section 6 in the board of Commercial Enterprise, in that it consists of a matrix of numbers with one column 9 representing the throws obtainable on the die; a second column representing bonus order volume; and the remaining columns 11 representing normal order volume. In operation, the Market Volume section is used in the same manner as the Trading Profit section in Commercial Enterprise. The sales price per unit, manufacturing costs per unit and Market Volume are set, at the start of the game, by placing a banker's mascot on the square, or at the head of the column, which is fourth from the left of each of the three sections. Thereafter, the banker's mascots are moved in response to instructions on the cards which are drawn by the banker. As indicated above, the manufacturing cost section determines (in conjunction with the Market Volume section) the amount of money to be paid by a player to the banker at the time an order is taken (i.e. each time he throws the die). The sales price section states the price for which each unit ordered can be sold to the bank at the end of the round (corresponding to the end of a financial year). As in the case of Commercial Enterprise, a player may obtain the right to receive royalties if he has an appropriate Market Development Option card. For his rights to be valid, the player must place his mascot on the royalty section for the appropriate enterprise. The player may then collect, at the end of a round, the stated royalty from any other player who obtains any order whether through a normal trading order or through a bonus order during that round. The royalty is payable on all orders taken during the year, even though some of these orders may have been obtained prior to the award of a royalty. A person holding a royalty card is responsible for policing and supervising the collection of his royalties at the end of a round.

The options open to players when it is their turn to throw the die are as described above in relation to Commercial Enterprise, and are set out in the information zone 12.

Setting up the game

1. Appoint one of the players as banker. Alternatively one person who does not wish to take part in the actual play may take the sole duties of the banker.

2. The banker (a) issues each player with £ 75,000 or $75,000 in monetary tokens; (b) shuffles the Chance, Market Development Option, Economic Factor, Market Volume, Market Sales Price and Manufacturing Cost Price cards, and places them in a suitable position, which may be on the board; (c) places one banker's mascot on the start position of the Banker's Year; and (d) positions eighteen banker's mascots in the sales price 14, cost price 15 and market volume 13 sections of each market area in the square or column fourth from the left in each case.

3. - as Commercial Enterprise.

4. The banker establishes the opening trading position for each market area by (a) drawing 6 market volume cards and following the instructions on each card for each market area commencing with Breweries, and, moving in a clockwise direction, finishing with General Engineering 3*f*; and (b) repeating the procedure described in (a) above for the market sales price cards and sections and for the manufacturing cost cards and sections.

The Play

1. The player on the immediate left of the banker commences play by throwing the die. The number thrown allows the player to secure a trading order in any market area for which he occupies a factory, and to take an option. To secure an other, the player places one of his mascots on the appropriate square of the Market Volume section 13, i.e. the square which aligns with the number thrown on the die and with the banker's mascot (at the head of the operative column). For example, assume a player occupies a Textile factory and a Furniture factory and the banker's mascots are positioned at the Market Volume columns headed 67 and 70 respective; and at £ 150 and £ 120 in the manufacturing cost section of the Textile and Furniture market areas, respectively. The player throws a 3. He may therefore secure an order for 68 units of Textiles products or 71 units of Furniture products. The player may then immediately pay to the banker the cost of the order secured; either £ 10,200 (68 × £ 150) for the Textile order of £ 8,500 (71 × £ 120) for the Furniture order. The player will obviously be influenced in his choice of markets by the profitability of each enterprise. The player then places his mascot on the appropriate square in the Market Volume section 13 to denote that that order has been taken and that it is not available for other players until it becomes free again at the year's end. The nature of the option available to the players is as described above in Commercial Enterprise. If a player wishes to purchase an order from the bank, but has insufficient monetary tokens, he may take an overdraft from the bank at an agreed rate of interest.

2. Each player then takes it in turns to throw the die and play as described in 1 above.

3. - as Commercial Enterprise.

4. - as Commercial Enterprise.

5. When the year end is reached, each player (1) sells all the orders he has secured to the banker at the current market sales price; (2) forfeits the largest order(s) where he has secured an order which cannot be covered by his production capacity (as described above in Commercial Enterprise); (3) pays any royalties due; (4) removes his mascots from the Market Volume section 13; (5) repays the banker any overdraft obtained together with the agreed interest; and (6) pays the banker the appropriate rent in advance for each factory leased (i.e. carrying on from the last year). Also at the year end, the banker (1) after he has paid out all the players and returned their mascots, and has collected all the rents due, he adjusts the trading position for each market area by drawing a further 6 Market Volume, 6 Market Sales price and 6 Manufacturing Costs cards and following the instructions on each card. 6. - as Commercial Enterprise.

7. The banker moves onto the squares for the subsequent year on the Banker's Year Board, assuming that there is no outstanding Economic Factor card instructing him to do otherwise.

8. Play continues until an agreed number of years have been played or an agreed time elapsed.

9. At the end of the game each player converts his factories to cash at the premium price, and totals his cash to find the winner (being the player with the most money).

Third Embodiment - Private Enterprise

This game, the most complicated of the three embodiments, introduces inter-trading between players and a variety of trading situations from which to choose. Inter-trading takes place through players acquiring agencies. Thus, a fourth element, involving the agents' price, the agency volume and the payment of sales costs, is introduced into the profit computations. The possible trading transactions during the course of a game can thus be as follows:

(1) Player buys from bank - volume x cost At the year end: player sells to the bank — volume x sales price but the player pays his own sales costs;

or (2) Player buys from bank - volume x cost plus agency volume X cost; And then immediately player sells to agent - volume x agent's price plus agency volume x agent's price, and the player recoups his sales costs from the agent;

or (3) Agent buys from player - volume x agent's price plus agency volume x agent's price. At the year end, agent sells to the bank - volume x sales price plus agency volume x sales price, and the agent pays the players sales costs.

In addition to the above, players and agents may also be involved in buying and selling bonus volume orders. In practice a player's trading deals will be made up of a combination of the above transations. Agencies are obtained as an agency card from the Market Development Option stack.

Figure 3:
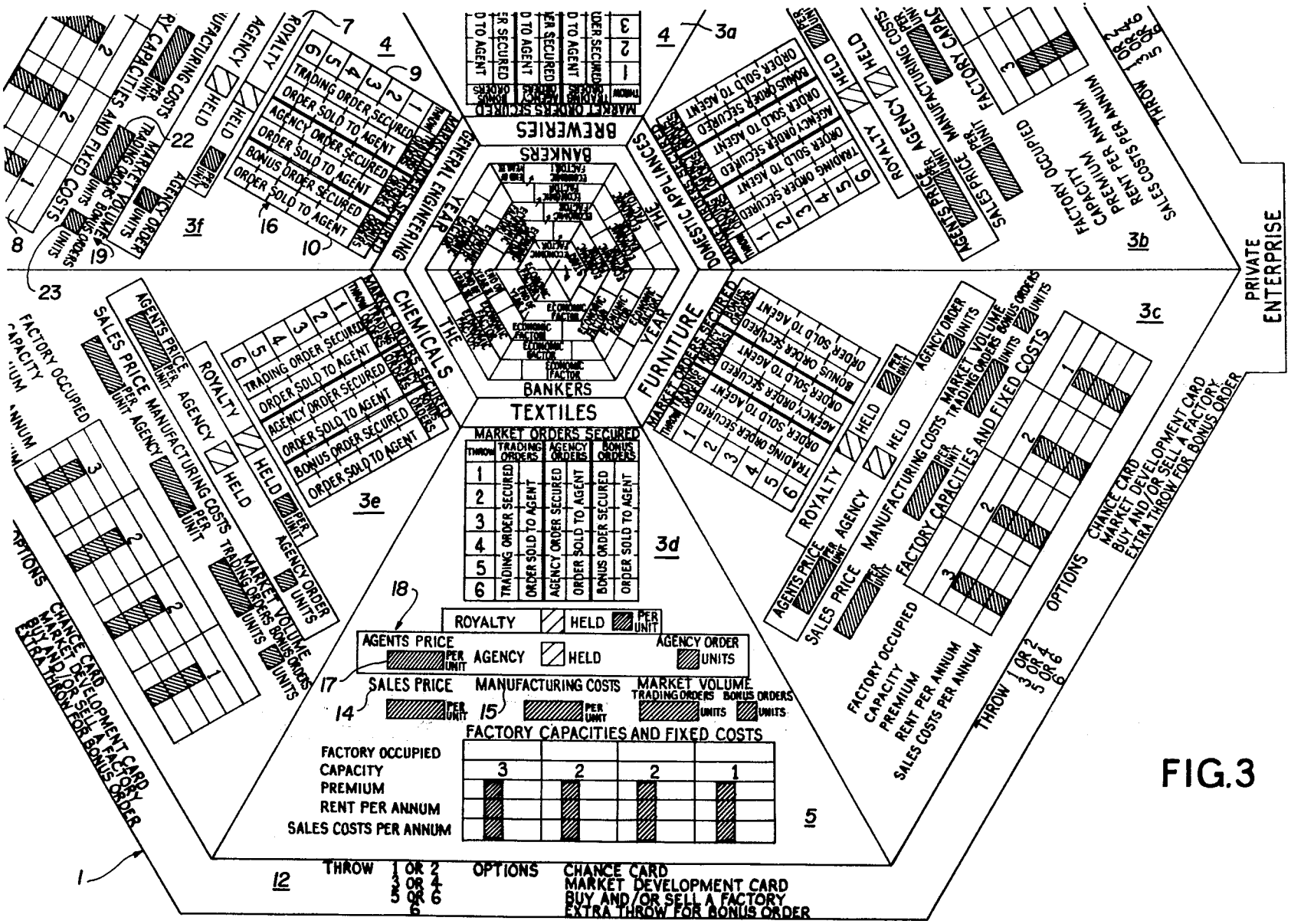
FIG. 3 shows a blow-up of a portion of the game board for use in the embodiment known as "private enterprise"

The board used in private enterprise is shown in FIG. 3. As previously, the board consists of two main sections, the first being the banker's year section 2 which is identical to that on the board for the game Free Enterprise, and six enterprise areas 3*a* to 3*f*. The enterprise areas contain a primary area 4 and a secondary area 5 as already described. The tabulation in the primary area 4 is of Market Orders Secured 16. The secondary area is subdivided into royalities 7; agency 18; sales price manufacturing costs 15; market volume 19; and factory capacities and fixed costs 8. Unlike the boards for the other two games, fixed matrices are not shown on the board. Instead, there are a series of matrix cards (see FIG. 18) for the various economic determinants, the cards being selected at the start of the game and the operative values being shown on the board by numerical indicators, e.g. dice located in recesses such as 17 in the board. The values shown on the visible faces of the dice thus serve to replace the numerical values in the matrices shown on the boards for Commercial Enterprise and Free Enterprise. Except for the complications introduced into trading by the existence of an agency system, the calculation of the amount to be paid when an order is obtained, and the amount to be received when an order is sold, are the same as described above in relation to the game Free Enterprise. The market volume section includes recesses 22 (for recording trading orders) and 23 (for recording Bonus orders). The recesses in the trading orders, manufacturing costs 15, sales price 14 and agents price 18 parts of the board will take three dice side by side. The values available for the various economic determinants can be augmented by the use of two sets of dice, one set bearing numbers (not pips) from 0 to 5, and the other set bearing the numbers 3, 4, 5, 7, 8 and 9 (six being represented by an inverted 9). In general, then, the game Private Enterprise involves a very complicated trading situation where the overall market can expand or contract, and where an infinitely variable trading pattern is possible. The game makes strenuous demands upon the players' cash management. The setting up and playing of the game will now be described in greater detail:

Setting up the game

1. Appoint one of the players as banker. Alternatively one person who does not wish to take part in the actual play may take the sole duties of the banker.

2.The banker (a) issues each player with £ 100,000 or $100,000

(b) shuffles the chance, market development option, economic factor, market volume, market sales price and delivered cost price cards, and places them in the positions provided (c) places the banker's mascot on the start position of the Banker's Year (d) having agreed with the players the market criteria to be used, places the numbered dice in the appropriate section of each market area,for example:
Royalty per unit
Market Sales Price
Agents Price
Manufacturing Cost
Market Volume
Bonus Order
Agency Orders
and for the Factories
Capacity of Factory
Premium
Rent per Annum
Sales and Distribution Costs p.a.

3. Each player (a) selects a company name and mascots (b) decides in which factories to operate, up to a maximum capacity of four (c) pays the banker the appropriate premium, rent and sales costs for the factories occupied.

4. The banker establishes the opening trading position for each market area by (a) drawing 6 market volume cards and following the instructions on each card for each market area commencing with Breweries 3*a* and moving in a clockwise direction, finishing with General Engineering 3*f*.

(b) repeating the procedure described in 4(*a*) above for the market sales price cards and sections and for the delivered and manufactured cost cards and sections. The agents price is adjusted in line with the sale price - see the matrix card of FIG. 18.

The Play

1. The player on the immediate left of the banker commences play by throwing the dice. The number thrown allows the player to firstly (a) secure a trading order in any market area for which he occupies a factory. The player places his mascot against the units ordered by reference to the number thrown, the actual quantity being shown in the market volume section (for example a player occupies a Textile factory and a Furniture factory and the market volume for each area is 71 units and 62 units respectively and the manufactured cost is £ 115 and £ 135 per unit respectively). The player must then immediately pay to the banker the cost of the order secured in the above example either £ 8165 (71 units at £ 115 each) or £ 8370 (62 units at £ 135 each). The player will obviously be influenced in his decision by the overall profitability of each area. The player then places his mascot on the appropriate order section to denote that the order has been taken and that it is not available for other players until it becomes free again at the year end; then (b) excercise an option, as follows:

| Number Thrown | Option |
|---|---|
| 1 or 2 | Chance Card (Free) |
| 3 or 4 | Market Development Option (Pay the Banker 1000) |
| 5 or 6 | Buy and/or sell a Factory |
| 6 | Extra Throw for a Bonus Order |

notes

(1) when buying a factory, the premium rent and sales costs are payable immediately to the banker

(2) When selling a factory only the premium is recoverable from the banker, the rent and sales costs already paid being forfeited

(3) Factory premium sale proceeds may be offset against monies payable and the balance paid to or collected from the banker

(4) When a 6 is thrown a player may exercise the option relating to factories or to an extra throw but not to both options

(5) when a player draws an agency option card from the market development cards (a) he may secure the option by paying the sales costs of each factory occupied in the appropriate market area, to the occupier, and then places his mascot on the appropriate section (b) thereafter if his competitors wish to obtain an order in the market area where an agency is held (i) they are entitled to acquire the additional agency orders at the manufactured cost per unit (ii) they must then sell the total units ordered (i.e. trading orders, bonus orders and agency orders) to the agent at the agents price (iii) the agents must then immediately pay the total purchase price to the manufacturer and placed his mascot in the appropriate section next to the manufacturers mascot for each set of units ordered (c) the agent sells the units at the year end to the banker at the full market sales price (d) additional agency orders are only obtainable with trading orders and cannot be obtained with any bonus orders secured (e) having exercised his option to hold an agency, the agent must purchase all orders manufactured whilst the agency is held except those orders for which a manufacturer has no capacity. The agent may relinquish his agency at the beginning of any year but not paying the sales costs to the manufacturer by withdrawing his agency mascot and by returning the agency market development card to the pack (f) when an agency is relinquished, the agency orders are no longer available (6) The options cannot be exercised before the trading order, if any, has been taken.

2. Each player than takes it in turns to throw the dice and to play as described in 1 above.

3. After each player has thrown and played, the banker throws and moves his mascot the appropriate number of sections on the banker's year.

4. Play continues with each player throwing the dice in turn until the banker's mascot reaches or passes the year end section on the banker's year.

5. When the year end is reached (a) Each player (1) sells all the orders he has manufactured or purchased as an agent to the banker at the current market sales price (2) forfeits the largest order(s) where he has either manufactured or secured as an agent an order which cannot be covered by product capacity (3) pays any royalties due (the manufacturer not the agent is responsible for paying royalties)

(4) removes his mascots from the market volume section (5) repays the banker any overdraft obtained together with the stated interest (6) pays the banker the appropriate rent and sales costs in advance for each factory leased (b) The banker after he has paid out all the players and returned the mascots to the players and he has collected all amounts due for rents and sales costs, he resets the trading position for each market area by drawing a further 6 market volume, 6 market sales price and 6 delivered cost price cards and follows the instructions on each card. The agency prices are moved in line with the Market Sales Price.

(c) Any player who holds any agency and after examining the reset trading position, wishes to continue his agency, he pays the sales costs to each occupier of a factory in his market area.

6. A further year's trading when commences with the player who threw second in the first year. The player who threw first then becomes the last player to throw followed by the banker. Therefore in subsequent years each player should get the opportunity to throw first.

7. The banker moves onto the subsequent year on the Banker's Year Board.

8. Play continues until an agreed number of years have been played or an agreed time elapsed.

9. At the end of the game each player (a) converts his factories to cash at the premium price (b) totals his cash to find the winner (being the player with most money)

What is claimed is:

1. A game in which the players are involved in a trading situation, trading transactions between the players being determined according to the operation of a plurality of economic determinants, the game comprising:

(a) game mascots;

(b) currency tokens;

(c) a die or dice;

(d) a plurality of sets of cards of at least two kinds, the first kind being economic determinant cards which bear instructions determining the operation of at least one variable economic determinant relating to market transactions undertaken in the course of the game, and the second kind being option cards which bear instructions concerning options open to the player;

(e) a game board having (1) a track divided into a plurality of spaces over which at least one of the game mascots is moved and on which said at least one game mascot is brought to rest, said track representing a predetermined time interval of at least one trading year and including indicia representing the end of the or each trading year, and at least some of said spaces bearing further indicia giving instructions to select one of said economic determinant cards; (2) a plurality of discrete zones bearing indicia representing distinctive enterprises which may be industrial, commercial and/or service enterprises, and including primary areas containing tabulated indicia relating to the values of at least a first economic determinant the or one table of which includes a column containing numerical indicia corresponding to the numerical indicia on the die or dice whereby the number obtained by a throw of the die or dice is related to the operation of said at least one economic determinant, and secondary areas bearing indicia relating to the values of at least a second economic determinant which is independent of said first economic determinant and is also independent of the numerical indicia on the die or dice its operation being determined by the players making a choice at least at the start of the game, and (3) an information zone setting out instructions relating the respective sets of option cards to the numerical indicia on the die or dice; and (f) means for denoting (1) trading transactions made by the players and (2) the values of variables pertaining at a given time during the course of the game.

2. A game as claimed in claim 1, wherein there are six enterprise zones on the game board arranged as a hexagonal array.

3. A game as claimed in claim 1, wherein one of the economic determinants is trading profits and another of said economic determinants is market profitability, the values of the trading profits being tabulated in said primary areas of each of the enterprise zones on the game board in a series of columns adjacent said column containing numercial indicia corresponding to the numerical indicia on the die or dice, the column of values operative at any given time being a function of the selection at predetermined times during the course of the game of one of a set of market profitability cards.

4. A game as claimed in claim 1, wherein the economic determinants include sales price, manufacturing costs and market volumes, and wherein the values relating to market volume are tabulated in said primary areas of each of the enterprise zones on the game board in a series of columns adjacent said column containing numerical indicia corresponding to the numerical indicia on the die or dice, the column of values operative at any given time being a function of the selection at predetermined times during the course of the game of one of a set of market volume cards.

5. A game as claimed in claim 4, wherein the economic determinants further comprise agent's costs and agent's selling price.

6. A game as claimed in claim 4, wherein the economic determinants further comprise royalties.

7. A game as claimed in claim 1, wherein said secondary areas in each of the enterprise zones of the game board bear indicia relating to factory capacities and fixed costs.

8. A game as claimed in claim 1, wherein said track is located near the center of the game board.

9. A game as claimed in claim 1, wherein said sets of option cards comprise chance cards and market development cards.

10. A game as claimed in claim 9, wherein said information zone bears indicia indicating that the numbers 1 or 2 on the die or dice give the option of a chance card; that the numbers 3 or 4 on the die or dice give the option of a market development card; that the numbers 5 or 6 on the die or dice give the option of factory purchase and/or sale; and that the number 6 on the die or dice gives the option of an extra throw for a bonus.

11. A game as claimed in claim 1, wherein some of the game mascots constitute the means for denoting (1) trading transactions made by the players, and (2) the values of variables pertaining at a given time during the course of the game.

12. A game as claimed in claim 1, wherein the game board is formed with a plurality of recesses into which numerical indicators can be placed to represent the values pertaining at any given time for at least some of the economic determinants.

13. A game as claimed in claim 12, wherein said numerical indicators comprise further dice.

14. A game apparatus, comprising:

(a) a playing marker;

(b) simulated money;

(c) at least one die;

(d) at least two sets of cards, each of the cards of one of said sets having a common indicia on one side thereof and one kind of instructions on the other side, and each of the cards of the other of said sets having a common indicia on one side thereof different from the common indicia of said first set of cards, and a kind of instructions on the other side different from the kind of instructions on said first set of (e) a game board having (1) a track divided into a plurality of spaces over which said playing marker is moved and on which said playing marker is brought to rest, at least some of the spaces of said track having indicia thereon giving instructions to select a card from one of said sets of cards, (2) a plurality of discrete zones; each of said zones bearing indicia which is independent of the indicia in the other zones, each of said zones including primary areas containing tabulated indicia relating to a first economic determinant and including a line or column bearing numerical indicia corresponding to the numerical indicia on said die, and secondary areas bearing indicia relating to a second economic determinant, and (3) an information zone bearing indicia giving certain instructional information about the play of the game.

15. A game apparatus in accordance with claim 14, wherein said plurality of discrete zones on said game board are so arranged on the surface of said game board so as to be substantially equally spaced about a vertical axis through the center of the game board.

16. A game apparatus in accordance with claim 14, wherein said game board is in the shape of a polygon with a number of sides equal to the number of said discrete zones and wherein each of said discrete zones lies a sector of said polygon bounded by one of said sides and the radii passing through the corners at the end of said side.

* * * * *